United States Patent [19]

Waters

[11] 4,437,923

[45] Mar. 20, 1984

[54] MULTICOLOR PRINTING PLATE JOINING

[75] Inventor: William J. Waters, Cleveland, Ohio

[73] Assignee: The United States of America as represented by the Adminstrator of the National Aeronautics and Space Administration, Washington, D.C.

[21] Appl. No.: 425,203

[22] Filed: Sep. 28, 1982

[51] Int. Cl.[3] ..... B44C 1/22; C23F 1/02; B41M 1/00; B21D 39/00

[52] U.S. Cl. ..... 156/630; 101/395; 156/654; 156/905; 228/165

[58] Field of Search ..... 156/629, 630, 634, 656, 156/654, 645, 644, 905; 101/368, 382 R, 383, 395; 228/165, 174

[56] References Cited

U.S. PATENT DOCUMENTS 1,680,097 8/1928 Eaton ..... 101/395

*Primary Examiner*—William A. Powell

*Attorney, Agent, or Firm*—Norman T. Musial; John R. Manning; James A. Mackin

[57] ABSTRACT

The object of the invention is to join or fuse an upper plate having ink flow channels and a lower plate having a multicolored pattern, the joining being accomplished without clogging any ink flow paths.

A pattern having different colored parts (11–14) and apertures is formed in a lower plate (10). Ink flow channels (111–114) each having respective ink input ports (211–214) are formed in an upper plate (11).

The ink flow channels (111–114) are coated with solder mask and the bottom of the upper plate (11) is then coated with solder. The upper and lower plates are pressed together at from 2 to 5 psi and heated to a temperature of from 295° F. to 750° F. or enough to melt the solder.

After the plates (10,11) have cooled and the pressure has been released, the solder mask is removed from the interior passageways by means of a liquid solvent.

9 Claims, 1 Drawing Figure

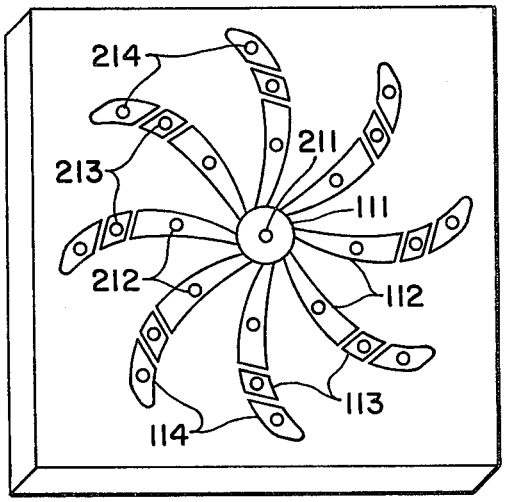
214
211
213
111
212
112
113
114
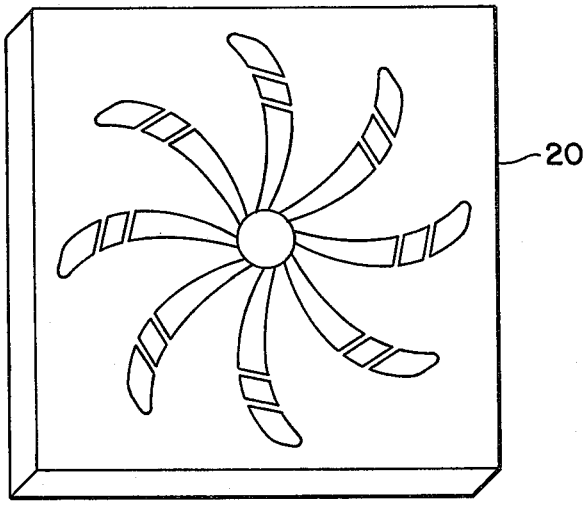
20
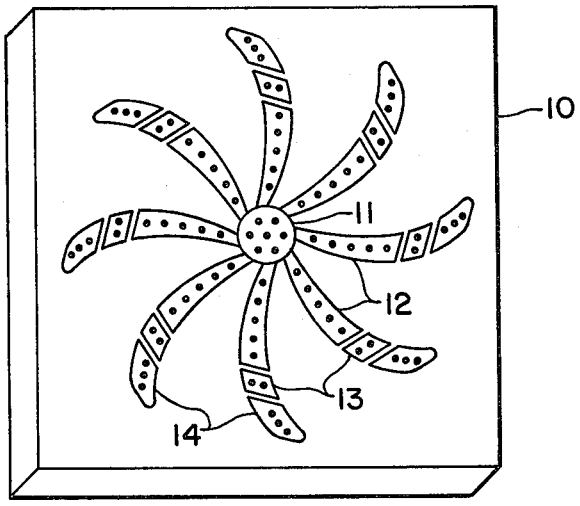
10
11
12
13
14

MULTICOLOR PRINTING PLATE JOINING

DESCRIPTION

ORIGIN OF THE INVENTION

The invention described herein was made by an employee of the United States Government and may be manufactured or used by or for the Government without the payment of any royalties thereon or therefor.

TECHNICAL FIELD

This invention relates to printing plates and is directed more particularly to a plate for printing images comprises of two or more colors.

One method of printing multicolor images involves printing each color separately. This method is quite expensive and time consuming because a separate plate is needed for each color and, except for rotary presses, a separate printing run must be made for each color.

Flat multicolor printing plates are known and generally comprise a lower plate and an upper plate with a plastic gasket between them. In such plates a pattern of the image to be printed is formed in the paper-contacting surface of the lower plate and each separate part of the pattern receives ink from ink distribution channels in the upper plate. The ink distribution channels in the upper plate have the same general outline as the various parts of the pattern in the lower plate and the gasket has the same pattern as the ink distribution channels.

In making this type of multicolor printing plate, the gasket is pressed between the upper and lower plates while the plates are heated. The result often is that the plastic melts and expands into the various ink distribution channels in other openings so that ink is not properly distributed in the lower plate.

BACKGROUND ART

U.S. Pat. No. 2,514,469 to Burkhardt discloses a heat exchanger which includes one pre-formed metal plate with a plurality of corrugations or deformed areas into which pressurized water is injected to clean solder from existing passageways. A series flow passageway is established between superimposed sheet metal portions as a result of the bonding material being applied in a particular pattern to one of the sheet metal portions. Other areas of the sheets are plated with copper or zinc and covered with chromium to prevent them from being bonded.

U.S. Pat. No. 2,421,607 to Fowler discloses a method of making a metallic printing screen by laminating a solder coated screen and solder coated plate under pressure while the solder is plastic.

U.S. Pat. No. 4,021,901 to Kleine et al discloses a method for manufacturing a heat exchanger from metal sheets having a weld inhibiting material applied to one of the sheets. The sheets are clamped together and pressure-welded and hot-dashed rolled. The portions which do not weld together because of the weld-inhibiting material are then inflated by introducing air or water to form a system of internal tubular passageways.

U.S. Pat. No. 3,394,446 to Valyi discloses the method of forming a composite metal structure which includes a weld-inhibiting material. Because of the weld-inhibiting material, a pattern of passageways may be formed by the injection of fluid into areas in which welding was inhibited.

U.S. Pat. No. 3,483,616 to Shomphe discloses a method for forming a printed circuit board. An insulating board having conductor patterns on both sides and eyelet connector holes between the patterns is coated with a protected coating and then passed through a soldering machine. Solder is applied on the unprotected areas of the conductor pattern.

U.S. Pat. No. 3,048,916 to Gahlinger discloses a method of making welded passageway panels. A weld-resist pattern is printed on one-half of a metal sheet which is then folded over and subjected to high temperature and pressure. The unwelded area is then pressure-expanded to form passageways.

DISCLOSURE OF THE INVENTION

In accordance with the invention patterns corresponding to the various colors of an image to be printed are formed in the paper contacting surface of a printing plate. Each individual color pattern has a plurality of apertures extending through to the back surface of the printing plate.

A backup plate to be fused to the printing plate has ink distribution channels formed therein with each ink distribution channel including a port which extends through to the back of the backup plate and to which appropriate tubes supplying colored ink are connected. The ink distribution channels may, but need not, correspond to the exact size and shape of the respective pattern parts in the printing plate, the requirement being that ink distribution channels each encompasses all of the apertures extending through the printing plate from the various pattern parts.

To make a complete printing plate, the ink flow channels of the backup plate are coated with a solder mask material which can be removed by a liquid. A layer of solder is then applied to the backup plate and the backup plate is positioned against the printing plate. While the plates are under pressure they are heated sufficiently to make the solder plastic and allowed to cool. The plates are now fused together without blockage of any of the ink distribution channels or the ink flow apertures. The solder mask material is removed by forcing a suitable solvent through the ink flow apertures, channels and ports.

BRIEF DESCRIPTION OF THE DRAWING

The single FIGURE of the drawing shows the printing plate and backup plate used to make a multicolor printing plate in accordance with the invention and also shows the prior art gasket used between the plates.

BEST MODE FOR CARRYING OUT THE INVENTION

Referring now to the single FIGURE, the printing plate 10 and a backup plate 11, the two main components of a multicolor printing plate made in accordance with the invention, are shown. As viewed in the FIGURE the bottom or paper contacting surface of plate 10 has a pattern of a multicolored image as, for example, a multiblade, high efficiency propeller formed therein. The propeller pattern on the bottom surface of plate 10 comprises a hub 11 corresponding to a first color, inner blades 12 corresponding to a second color, blade stripes 13 corresponding to a third color and blade tips 14 corresponding to a fourth color. The various parts of the pattern are formed by engraving, etching or the like. An alternative method involves providing the pattern in a suitable form material over which the plate 10 may be cast.

Each of the pattern parts 11 through 14 is provided with one or more apertures extending through plate 10 to its top surface. The number, size and distributions of these apertures is dependent on the ink viscosity and pressure, as is known to those skilled in the art.

The backup plate 11 is provided with ink flow channels 111 through 114 corresponding to the pattern parts 11 through 14 of printing plate 10. Although the ink flow channels 111 through 114 are similar in size and shape to the corresponding pattern parts 11 through 14, this is not a requirement. It is only necessary that each of the ink flow channels 111 through 114 encompass all of the apertures of a corresponding part of the pattern parts 11–14 in the printing plate 10.

Ink input ports 211 through 214 extend from respective ones of the ink flow channels 111 through 114 through to the top surface of backup plate 11. Inks of first, second, third and fourth colors are supplied to ink input ports 211 through 214 as required by the first, second, third and fourth colors to be printed by the pattern on plate 10.

In the single FIGURE there is shown a gasket 20 which is typical of the prior art. The gasket 20 of the prior art was generally a plastic material pressed between the plates 10 and 11 binding them together. The gasket 20 is not used with the method and apparatus of the instant invention.

According to the instant invention the ink channels 11 through 114 of backup plate 11 are coated with a material to which solder will not adhere. Such materials are well known in the art of printed circuit board manufacture where they are referred to as solder mask materials.

The solder mask material used to coat the ink channels 111 through 114 should be of the type which is soluble in some liquid to facilitate its removal after 10 and 11 are bonded together as will be described presently. Preferably, a water soluble mask material is used and is applied to the ink channels 111 through 114 by means of an appropriately sized brush.

Prior to fusing the printing plate 10 and the backup plate 11 into a unitary assembly, a coating of solder is applied to the bottom surface of the plate 11. Preferably, this is accomplished by wave soldering techniques used for making printed circuit boards. This technique involves passing the bottom surface of the plate 11 rapidly over a standing wave created in a mass of molten solder.

In order to fuse plates 10 and 11 together, the solder surface or bottom surface of plate 11 is placed against the top surface of plate 10 and the plates are pressed together by a suitable means such as a clamp so that the mutual contacting surfaces of plates 10 and 11 are under a pressure of from about 1 to about 5 pounds per square inch with about 2 pounds per square inch being the preferred pressure. While the plates are being pressed together, they are heated to a temperature of about 450° F. although a temperature range of from about 295° F. to about 750° F. is acceptable.

It will be understood that different type solders have different melting temperatures and that once the melting is reached the plates may be allowed to cool to room temperature after which the pressure applied to the plates is removed. With plates 10 and 11 now fused together, the liquid soluble solder mask previously applied to the inflow channels 111 through 114 of backup plate 11 must now be removed. This is accomplished by directing through the apertures in the bottom surface of plate 10 or through the ink input ports 211–214 a liquid which will dissolve the solder mask material.

In accordance with the present invention the preferred solder mask is water soluble and, therefore, the liquid injected through the ink input ports or through the apertures in the pattern on the bottom surface of plate 10 is water. The water has a temperature in the range of from 60° F. to 180° F. The higher temperatures will increase the rapidity with which the solder mask is removed.

To remove any water trapped in the ink flow passages, ports or aperture compressed air may be injected into the ink flow ports 211 through 214 in the backup plate 11 and/or through the apertures in the bottom surface of plate 10. Additionally, or as an alternative, the multicolor printing plate made in accordance with the invention may be heated in a suitable furnace or oven to dry any remaining solder mask solvent.

The plates 10 and 11 are preferably copper. However, other materials such as aluminum may be used. Some materials such as aluminum do require extra work in preparation as well as necessitating special solders and soldering fluxes.

It will be understood that changes and modifications may be made to the foregoing described invention by those skilled in the art to which the invention pertains without departing from the spirit and scope of the invention as set forth in the claims appended hereto.

I claim:

1. A method of making a plate for multicolor printing comprising the steps of:

(a) providing first and second plates each having a top and bottom surface;

(b) forming in the bottom surface of said first plate patterns of the images to be printed;

(c) forming a plurality of apertures extending through said first plate, said apertures being distributed within said patterns;

(d) forming in said bottom surface of said second plate a plurality of ink distribution channels, each channel having a shape such as to enclose all the apertures of a respective pattern when the plates are juxtapositioned;

(e) forming at least one ink input port in each distribution channel;

(f) coating each ink distribution channel of said second plate with a liquid removeable solder mask;

(g) coating said bottom surface of said second plate with solder;

(h) pressing the bottom surface of said second plate against the top surface of said first plate;

(i) heating said plates for a time period sufficient to fuse them together;

(f) flowing a solder mask dissolving liquid through the ports, apertures and channels of said plates to remove said solder mask whereby a solder-joined multicolor printing plate is produced.

2. The method of claim 1 wherein the coating of the bottom surface of the second plate is done by wave-soldering.

3. The method of claim 1 wherein said solder mask is a water soluble material and wherein said solder mask dissolving material is water at a temperature of from 60° F. to 180° F.

4. The method of claim 1 wherein said plates are pressed together at a pressure of from about 1 to about 5 lbs./in.$^2$.

5. The method of claim 1 wherein the heating of said plates is in a temperature range of from 295° F. to 750° F.

6. The method of claim 1 wherein said first and second plates are copper.

7. The method of claim 1 wherein said plates are pressed together at a pressure of about 2 lbs./in.$^2$ and heated to a temperature of about 450° F. to fuse them together.

8. The method of claim 1 wherein said patterns in said first plate are formed by etching.

9. The method of claim 1 wherein said patterns in said first plate are formed by engraving.

* * * * *